US010065329B2

(12) United States Patent
Offerman

(10) Patent No.: US 10,065,329 B2
(45) Date of Patent: Sep. 4, 2018

(54) SYSTEMS AND METHODS FOR ZIP-TIE CUTTING

(71) Applicant: THE BOEING COMPANY, Chicago, IL (US)

(72) Inventor: John Offerman, West Ashley, SC (US)

(73) Assignee: The Boeing Company, Chicago, IL (US)

( * ) Notice: Subject to any disclaimer, the term of this patent is extended or adjusted under 35 U.S.C. 154(b) by 219 days.

(21) Appl. No.: 14/815,034

(22) Filed: Jul. 31, 2015

(65) Prior Publication Data

US 2017/0028573 A1 Feb. 2, 2017

(51) Int. Cl.
*B26B 13/06* (2006.01)
*B65B 13/02* (2006.01)

(52) U.S. Cl.
CPC ..... *B26B 13/06* (2013.01); *B65B 13/027* (2013.01)

(58) Field of Classification Search
CPC ..... B26B 13/06; B65B 13/027
USPC ..... 83/53, 13; 30/290
See application file for complete search history.

(56) References Cited

U.S. PATENT DOCUMENTS 3,168,119 A 2/1965 Schwester et al.
4,459,717 A 7/1984 Halstead
5,000,232 A * 3/1991 Wolcott ..... B65B 13/027 140/123.6
5,309,802 A 5/1994 Mammosser
5,483,998 A * 1/1996 Marelin ..... B25B 25/005 140/150
5,566,726 A * 10/1996 Marelin ..... B25B 25/005 140/123.6
6,276,059 B1 8/2001 Kan
8,104,180 B2 1/2012 Swinford
9,398,903 B2 * 7/2016 McClellan ..... A61B 17/0401
2010/0206148 A1 8/2010 Reyes
2011/0265332 A1 11/2011 Cornell et al.
2013/0139392 A1 6/2013 Wright et al.

OTHER PUBLICATIONS

Panduit, Model GS4H, http://www.panduit.com/wcs/Satellite?c=Page&childpagename=Panduit_Global%2FPG_Layout&cid=1345565612156&locale=en_us&pagename=PGW_Wrapper&item_id=GS4H, Jul. 31, 2015. 1 page, Panduit.

* cited by examiner

*Primary Examiner* — Omar Flores Sanchez
(74) *Attorney, Agent, or Firm* — Joseph F. Harding; The Small Patent Law Group LLC

(57) ABSTRACT

A cutting tool is provided. The cutting tool includes a first member and a second member that are configured to be disposed on opposite sides of the free end of the cable tie. At least one of the first and second members is articulable toward the other. The first member includes a curved blade that is curved along at least a portion of the curved blade along a transverse direction perpendicular to a longitudinal axis defined by the free end of the cable tie. The second member has an opposed surface. Urging the curved blade toward and into contact with the opposed surface removes an end portion of the free end of the cable tie, with a remaining portion of the free end of the cable tie curved along at least a portion of the remaining portion of the free end along the transverse direction.

19 Claims, 7 Drawing Sheets

SYSTEMS AND METHODS FOR ZIP-TIE CUTTING

FIELD OF EMBODIMENTS OF THE DISCLOSURE

Embodiments of the present disclosure generally relate to systems and methods for cutting, for example cutting of free ends of cable ties or zip ties.

BACKGROUND OF THE DISCLOSURE

Various components may be secured with zip ties or cable ties. For example, one or more wires or cables of an airplane may be secured to each other and/or to a structure. After the wires or cables are secured, a free end of the zip tie or cable tie may extend outward from a loop of the cable tie, reducing space available, interfering with access, and/or providing an obstruction that may snag an article of clothing of an operator or otherwise impede or inconvenience the operator. Conventionally, such zip ties may be cut to be substantially flush with a loop securing the wires or cables. However, conventional approaches may leave a sharp or jagged edge that can cut or scrape an operator. Further, flush cut zip ties may make removal of the zip ties more difficult and/or less convenient.

SUMMARY OF THE DISCLOSURE

Accordingly, improved safety and/or convenience in cutting cable ties and/or removing cable ties, are provided in various embodiments disclosed herein.

Certain embodiments of the present disclosure provide a cutting tool (e.g., a cutting tool for a cable tie forming a loop about at least one object, with the cable tie having a free end extending from the loop, and defining a longitudinal axis extending along a length of the free end). The cutting tool includes a first member and a second member that are configured to be disposed on opposite sides of the free end of the cable tie, with at least one of the first and second members articulable toward the other of the first and second members. The first member includes a curved blade that is curved along at least a portion of the curved blade along a transverse direction that is perpendicular to the longitudinal axis. The second member has an opposed surface. Urging the curved blade toward and into contact with the opposed surface removes an end portion of the free end of the cable tie, with a remaining portion of the free end of the cable tie curved along at least a portion of the remaining portion of the free end along the transverse direction.

Certain embodiments of the present disclosure provide a cutting tool for a cable tie. The cable tie forms a loop about at least one object and has a free end extending from the loop. The cable tie defines a longitudinal axis extending along a length of the free end. The cutting tool includes an advancement mechanism, a first member, and a second member. The advancement mechanism is configured to grasp the free end of the cable tie and tighten the cable tie about the at least one object until a predetermined tension is achieved. The first member and the second member are configured to be disposed on opposite sides of the free end of the cable tie, with at least one of the first and second members articulable toward the other of the first and second members. Further, the advancement mechanism is configured to articulate the at least one of the first and second members toward the other of the first and second members after the predetermined tension is achieved. The first member includes a curved blade that is curved along at least a portion of the curved blade along a transverse direction that is perpendicular to the longitudinal axis. The second member includes an opposed surface. Urging the curved blade toward and into contact with the opposed surface removes an end portion of the free end of the cable tie, wherein a remaining portion of the free end of the cable tie is curved along at least a portion of the remaining portion along the transverse direction.

Certain embodiments of the present disclosure provide a method of cutting a free end of a cable tie forming a loop about at least one object, where the free end extends from the loop and defines a longitudinal axis extending along a length of the free end. The method includes positioning a cutting tool having first and second members with the first and second members disposed on opposite sides of the free end of the cable tie. The first member includes a curved blade that is curved along at least a portion of the curved blade along a transverse direction that is perpendicular to the longitudinal axis, and the second member includes an opposed surface. The method also includes urging the curved blade toward the opposed surface to remove an end portion of the free end of the cable tie to provide a cable tie having a remaining portion of the free end that is curved along at least a portion of the remaining portion along the transverse direction.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Embodiments of the present disclosure provide systems and methods for cutting, for example for removing portions of free ends of cable ties that have been used to position and/or secure various objects (e.g., wires or cables) in place. In various embodiments, a curved blade is used to cut the free end without resulting in sharp or jagged edges, thereby eliminating or reducing the risk of an operator being cut or scraped by a free end of a cable tie. Further, with the eliminated or reduced risk of being cut or scraped, the free end may be cut to have a longer extension than conventional approaches, facilitating easier removal of cable ties. In some embodiments, the curved blade may be incorporated into a conventional cable tie gun used to tighten a cable tie as well as cut the free end. In other embodiments, the curved blade may be utilized with a pivoting tool (such as a tool that employs a scissors- or pliers-type motion).

Embodiments of the present disclosure provide improved safety and convenience for the cutting of zip ties.

Figure 1:
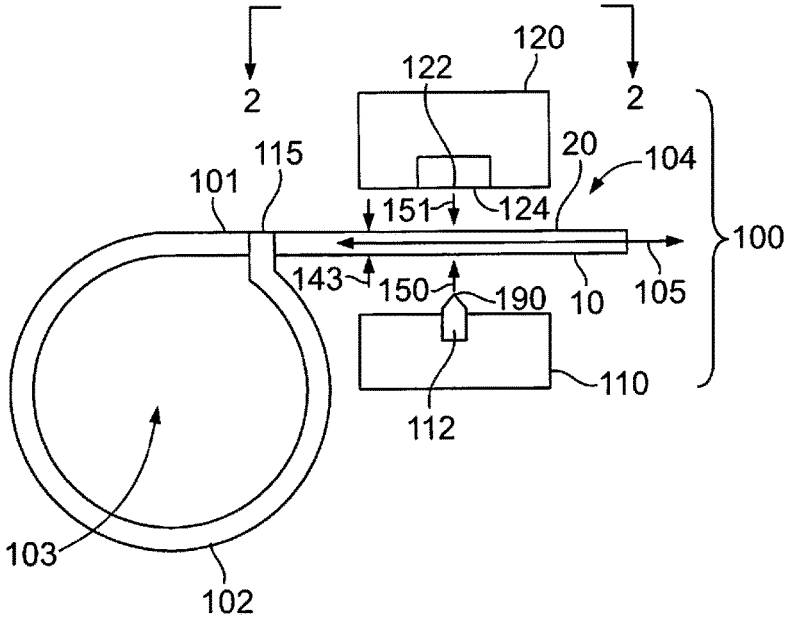
FIG. 1 provides a schematic block diagram of a cutting tool, according to an embodiment of the present disclosure.
Figure 2:
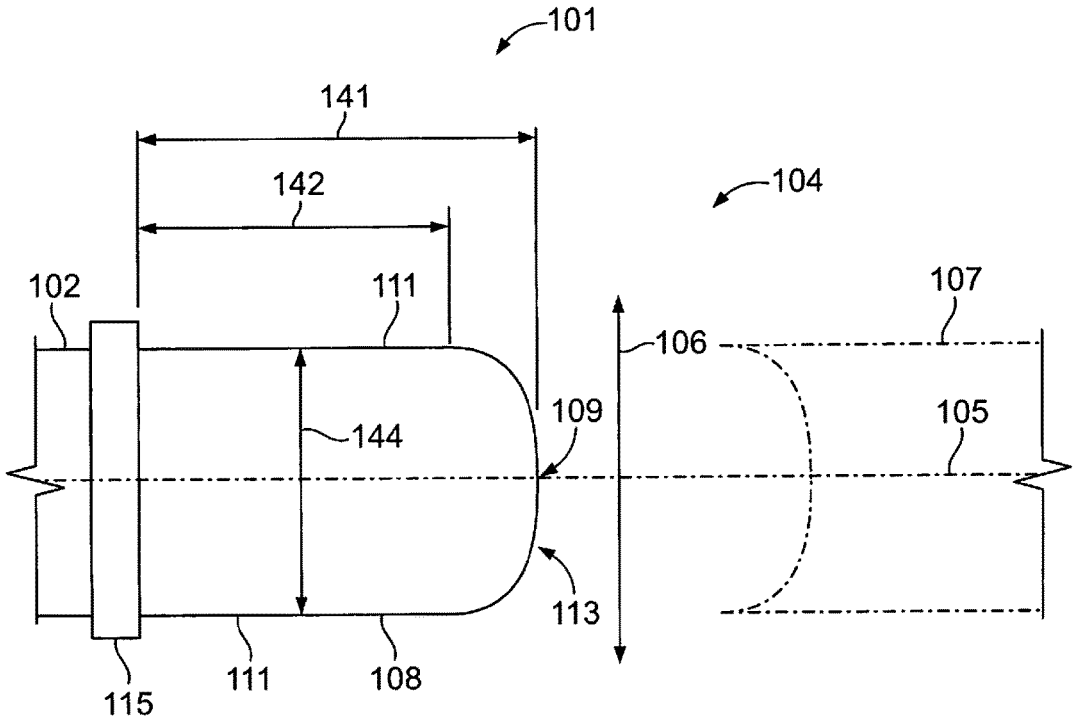
FIG. 2 provides a schematic plan view of a cable tie after being cut by the cutting tool of FIG. 1.

FIG. 1 provides a schematic block diagram of a cutting tool 100 used in conjunction with a cable tie 101, and FIG. 2 provides a schematic plan view of the cable tie 101 after being cut by the cutting tool 100. As best seen in FIG. 1, the cable tie 101 forms a loop 102 about an object 103. It may be noted the object 103 is represented as a single circle in FIG. 1 for ease and simplicity of illustration; however, the object 103 may represent more than one individual component or structure, such as a number of wires or cables formed in a bundle, and/or one or more wires or cables secured to a structural member. The cable tie 101 includes a free end 104 extending from the loop 102. The free end 104, for example, may be passed through a receiver 115 that may grasp the free end 104 (e.g., through a cooperating ratcheting mechanism) to secure the loop 102 about the object 103. As the free end 104 is urged away from the loop 102, the loop 102 tightens about the object 103. As seen in FIGS. 1 and 2, the cable tie 101 defines a longitudinal axis 105 that extends along a length 140 of the free end 104 of the cable tie 101. A transverse direction 106 (see FIG. 2) is oriented perpendicular to the longitudinal axis 105.

The cutting tool 100 may be used to remove a portion of the free end 104 of the cable tie 101 for convenience and/or safety. As seen in FIG. 1, the cutting tool 100 includes a first member 110 and a second member 120. The first member 110 and second member 120 are disposed on opposite sides 10, 20 of the free end 104 of the cable tie 101. For example, in the illustrated embodiment, the first member 110 is disposed below the free end 104 (or on the same side as the loop 102), while the second member 120 is disposed above the free end 104 (or on the opposite side of the loop 102). At least one of the first member 110 or the second member 120 is articulable toward the other of the first member 110 or the second member 120. For example, the first member 110 may be fixed and the second member 120 may be articulable toward the first member 110, the second member 120 may be fixed and the first member 110 may be articulable toward the second member 120, or the first member 110 and the second member 120 may be articulable toward each other. Accordingly, the first member 110 and the second member 120 may be understood as articulable with respect to each other.

Figure 5:
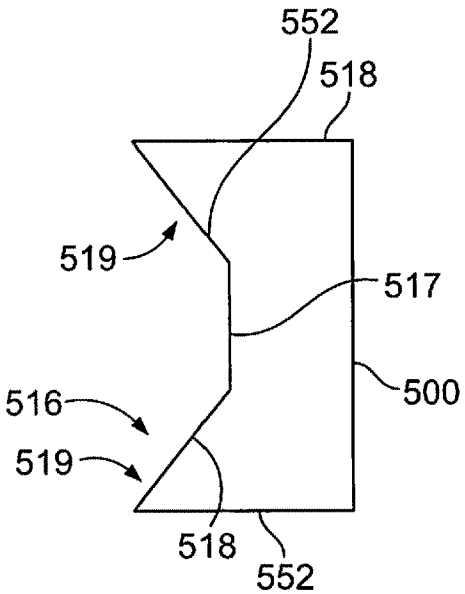
FIG. 5 illustrates an overhead view of a curved blade, according to an embodiment of the present disclosure.
Figure 4:
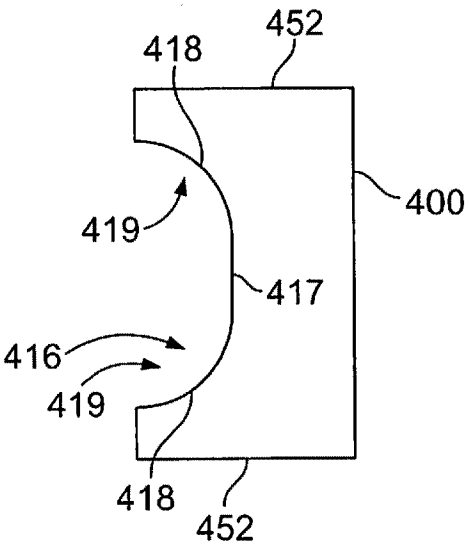
FIG. 4 illustrates on overhead view of a curved blade, according to an embodiment of the present disclosure.
Figure 3:
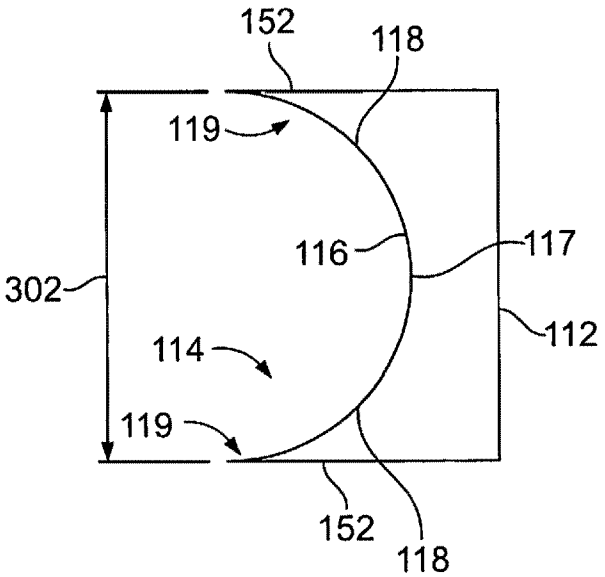
FIG. 3 illustrates an overhead view of the curved blade of FIGS. 1 and 2.

The first member 110 includes a curved blade 112 (see also, e.g., FIGS. 3-5 and related discussion). The curved blade 112 is curved along at least a portion of the curved blade 112 along the transverse direction 106. The curved blade 112 is configured to be urged toward the second member 110 (through a movement of the first member 110 toward the second member 120 along direction 150 and/or a movement of the second member 120 toward the first member 110 along direction 151), and to cut through the free end 104 of the cable tie 101 at or near a time of contact with the second member 110. The curved blade 112 may, for example, be made of steel and include a sharpened edge 190 that is configured to pass through and cut the free end 104 of the cable tie 110. The curved blade 112 may be securely fixed in the first member 110 to remain stable and oriented in a desired position during the cutting process.

The second member 120 includes an opposed surface 122 configured to cooperate with the curved blade 112 to remove a portion of the free end 104 of the cable tie 101. For example, the second member 120 may include a flat contact portion 124 against which the curved blade 112 is pressed, with the flat contact portion 124 helping to retain the free end 104 in a desired cutting position as the curved blade 112 is pressed through a thickness 143 of the free end 104. The flat contact portion 124 may define a planar structure that is parallel to a plane defined along a width 144 of the cable tie 101.

As seen in FIG. 2, when the curved blade 112 is urged toward and into contact with the opposed surface 122, an end portion 107 of the free end 104 is removed, leaving a remaining portion 108 of the free end 104 extending from the loop 102. The profile of the remaining portion 108 may be understood as complementary to that of the curved blade 112 and curved along the transverse direction 106, as the profile of the remaining portion 108 is formed by the curved blade 112. For example, in the illustrated embodiment, the curved blade 112 defines a concave profile 114 (see, e.g., FIG. 3), and the remaining portion 108 of the cable tie 101 defines a convex profile 113. Accordingly, a length 141 (e.g., taken from the receiver 115) along a central portion 109 of the remaining portion 108 of the cable tie 101 is greater than a length 142 taken along an edge 111 of the remaining portion 108 of the cable tie 101. Further, the curved blade 112 may be configured so that the transition from each of the edges 111 to the convex profile 113 and along the convex profile 113 is smooth or otherwise avoids sharp or jagged transitions (such as a 90 degree cut). Thus, if an operator brushes a hand against the remaining portion 108, the risk of being cut or scraped is eliminated or reduced. In the embodiment depicted in FIG. 3, for example, the concave profile 114 of the curved blade 112 is configured as a semi-circular profile 116. The concave profile 114 may define a half-circle (e.g., subtend an arc of 180 degrees), or as another example, may define a smaller portion of a circle (e.g., subtend an arc of less than 180 degrees). The length 141, for example, may extend a distance past the receiver 115. In some embodiments, for example, the length 141 of the central portion 109 of the remaining portion 108 of the cable tie 101 may extend ⅜" or more from the receiver 115. The length 141 may be longer than the length provided by conventional approaches due to the smooth profile of the remaining portion 108 that reduces the eliminating of cutting, scratching, or snagging relative to the jagged edges produced by conventional approaches. The longer extension of the remaining portion 108, in various embodiments, may make disengagement of the cable tie 101 from the receiver 115 and subsequent removal of the cable tie 101 from the object 103 easier and/or more convenient.

FIG. 3 illustrates an overhead view of the curved blade 112 that has the semi-circular profile 116 that may be used, for example, in connection the cutting tool 100 to form the convex profile 113 of the remaining portion 108 depicted in FIG. 2. As seen in FIG. 3, the curved blade 112 defines a semi-circular profile 116 that includes a middle portion 117 interposed between two edge portions 118. It may be noted that the back of the curved blade 112 is depicted as generally straight in the illustrated embodiment for ease of illustration; however, other shapes may be employed in various embodiments. For example, the back of the curved blade 112 may be similarly shaped to the concave profile 114 but offset a given thickness such that the curved blade 112 is shaped as a truncated ring-like section. The edge portions 118 define corresponding profiles 119 that are non-perpendicular to edges 152 of the curved blade 112 (and non-perpendicular to edges 111 of the cable tie 101 that is cut with the curved blade 112). For example, in the embodiment illustrated in FIG. 3, the edge profiles 119 define radiused portions that extend tangentially from the edges, with the semi-circular profile 116 having a diameter equal to the width 302 of the curved blade 112 and subtending an arc of 180 degrees (e.g., forming a half-circle). Accordingly, for a cable tie 101 that has a width 144 the same as the width 302 of the curved blade 112, the resulting remaining portion 108 has a half-circle profile with a diameter equal to the width 144. In various embodiments, the edge profiles may approach the edges asymptotically or at an acute angle. For example, the semi-circular profile 116 may define a larger diameter than the width 302, resulting in a flatter semi-circular profile that subtends an arc of less than 180 degrees. The curved blade 112 may be used to cut cable ties having a width equal to or lesser than the width 302. It may be noted that in the embodiment depicted in FIG. 3, the edge portions 118 and the middle portion 117 define a continuous profile in the shape of a semi-circle. However, in other embodiments, the middle portion 117 and edge portions 118 may define different shapes or form a discontinuous curve (e.g., the middle portion and edge portions may define different radii, the middle portion may be linear while the edge portions are curved, or the middle portion and edge portions may be linear portions joined in steps or otherwise approximating a smooth curve, among others).

FIG. 4 illustrates an overhead view of a curved blade 400 that may be used in connection with cutting tools as discussed herein. As seen in FIG. 4, the curved blade 400 defines a profile 416 that includes a middle portion 417 interposed between two edge portions 418. In the embodiment depicted in FIG. 4, the edge portions 418 define semi-circular profiles while the middle portion 417 is a linear portion oriented perpendicularly to the edges 452 of the curved blade 400. For example, the edge portions 418 may define radiused curves that extend tangentially from the edges 452 to the middle portion 417, subtending an arc of 90 degrees. Again, the edge portions 418 define corresponding profiles 419 that are non-perpendicular to edges 452 of the curved blade 400 (and non-perpendicular to edges of a cable tie that is cut with the curved blade 400). As with the curved blade 112, in various embodiments, the edge profiles 419 may approach the edges asymptotically or at an acute angle.

FIG. 5 illustrates an overhead view of a curved blade 500 that may be used in connection with cutting tools as discussed herein. As seen in FIG. 5, the curved blade 500 defines a profile 516 that includes a middle portion 517 interposed between two edge portions 518. In the embodiment depicted in FIG. 5, the edge portions 518 define linear portions at an acute angle to the edges 552 of the curved blade 500, while the middle portion 517 is a linear portion oriented perpendicularly to the edges 552 of the curved blade 500. As with the embodiments depicted in FIGS. 3 and 4, the edge portions 518 define corresponding profiles 519 that are non-perpendicular to edges 552 of the curved blade 500 (and non-perpendicular to edges of a cable tie that is cut with the curved blade 500). The particular arrangement depicted in FIG. 5 (and other figures) are meant by way of example, and other arrangements may be employed in various embodiments. For example, more than three linear segments may be employed. As another example, the junctions or connections between adjacent linear segments may be radiused, curved, or otherwise smoothed instead of angled as shown in FIG. 5. Further, in various embodiments, the junction between the curved portion of the blade and the edge of the blade may be chamfered, for example, to reduce or eliminate any potential sharp edges. It may be noted that the embodiments depicted in of FIGS. 4 and 5 provide examples of curved blades having at least one linear blade segment.

Figure 6:
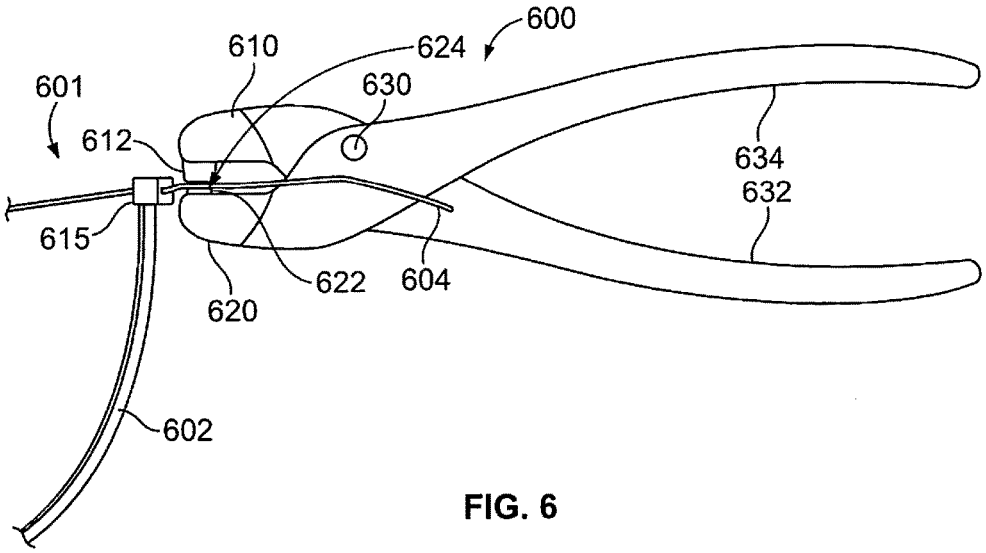
FIG. 6 provides a side view of a cutting tool having first and second members joined by a pivot, according to an embodiment of the present disclosure.
Figure 7:
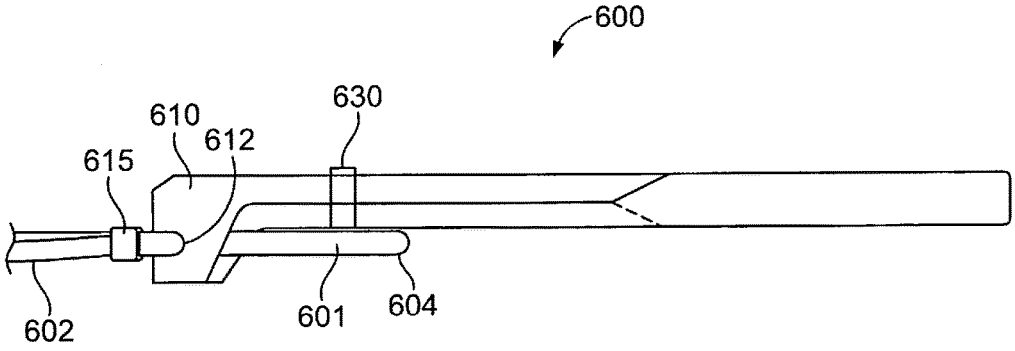
FIG. 7 provides an overhead view of the cutting tool of FIG. 6.

Various different arrangements may be used to articulate at least one of the first member 110 or the second member 120 toward each other to cut the cable tie 101. For example, FIG. 6 provides a side view of a cutting tool 600 that utilizes a pivot 630 to articulate a first member 610 and a second member 620 to cut a cable tie 601. The cable tie includes free end 604 extending from a receiver 615 used to form a loop 602. As best seen in FIG. 6, the first member 610 and second member 620 may be joined by the pivot 630 in a scissors- or pliers-like arrangement. The first member 610 includes a curved blade 612, and the second member 620 includes an opposed surface 622 that includes a flat contact portion 624. The curved blade 612 may be urged toward the flat contact portion 624 via the handles 632, 634 of the first member 610 and the second member 620, respectively, to cut the cable tie 602. In the illustrated embodiment, the curved blade 612 is brought downward toward the cable tie 601 to cut the free end 604, allowing an operator holding the cutting tool 600 to see the portion of the free end 604 that will be cut as the operator looks downward. The cutting tool 600 may be used in applications where the cutting tool 800 discussed herein or other cutting tool using a conventional zip tie gun may be inappropriate, for example, where slack is desired in the cable tie after securement and cutting of the free end. The cutting tool 600 may be particularly useful for low-torque zip tie applications, including temporary installations of holding wire bundles, cuts, holding parts, or the like on an airplane during manufacture, assembly, repair, and/or maintenance. Further, the cutting tool 600 (and/or other embodiments discussed herein) may be utilized in other factory applications, such as for zip ties holding banners, safety mesh and guarding, tooling fixtures, holding supplies, or the like, particularly in high traffic areas where operators are likely to come into contact with the zip ties.

Figure 8:
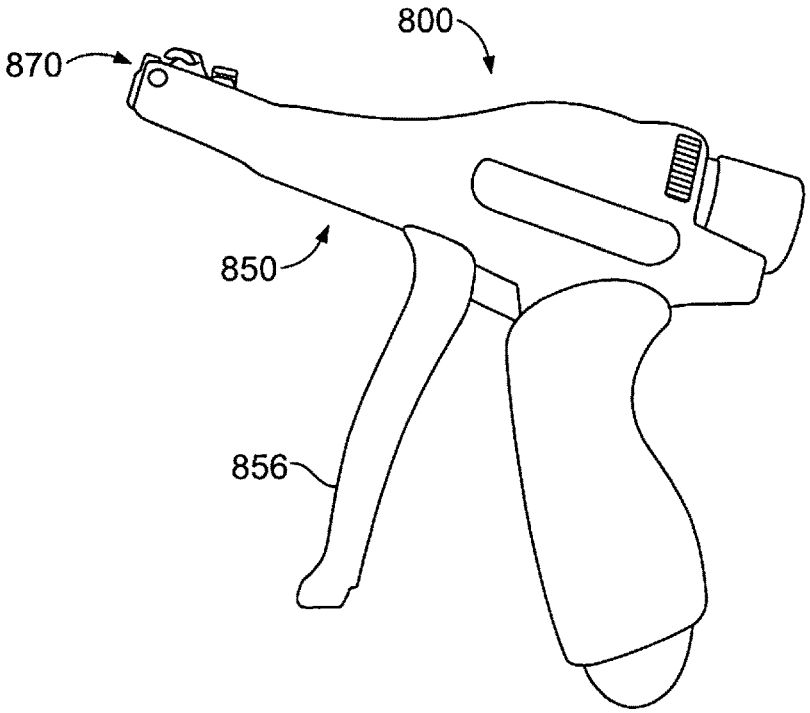
FIG. 8 provides a side view of cable tie gun, according to an embodiment of the present disclosure.
Figure 9:
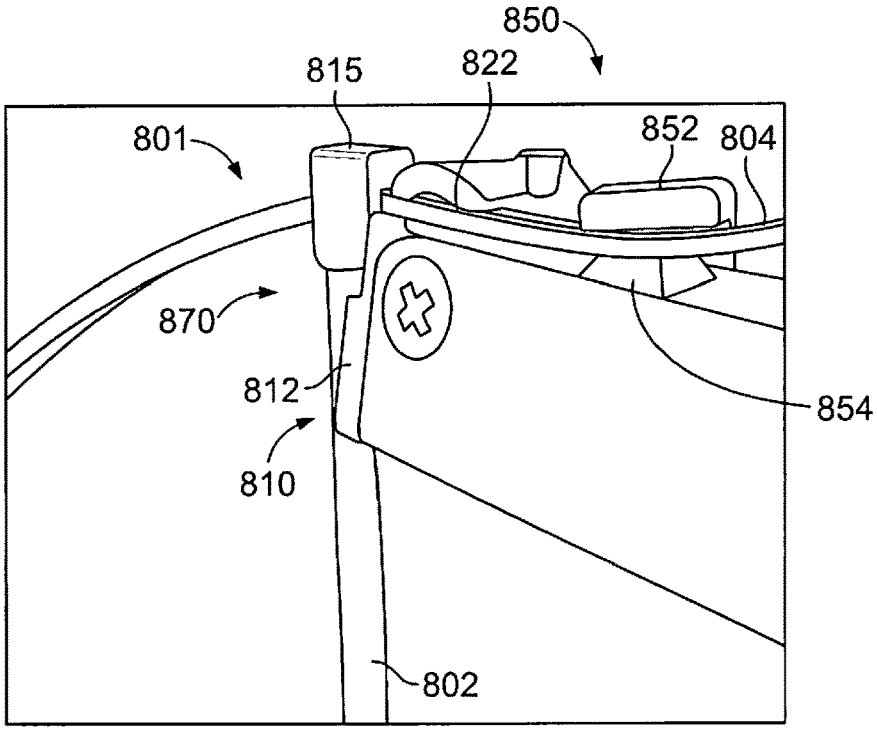
FIG. 9 provides an enlarged view of the front of the cable tie gun of FIG. 8.
Figure 10:
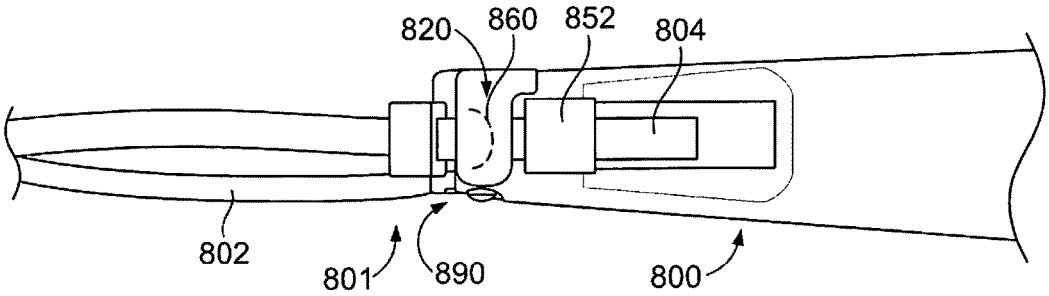
FIG. 10 provides a top view of the cable tie gun of FIGS. 8 and 9.

As an example of another arrangement that may be used with cutting tools disclosed herein, a standard or conventional cable tie gun may be provided with a curved blade and/or other aspects disclosed herein. Such a cable tie gun may include, for example, an advancement mechanism that pulls the cable tie securely through a receiver around one or more objects to provide a desired tension on the cable tie before a free end of the cable tie is cut. FIG. 8 provides a side view of cable tie gun 800, FIG. 9 provides an enlarged view of the front of the cable tie gun 800, and FIG. 10 provides a top view of the cable tie gun 800. The cable tie gun 800 includes a first member 810 and a second member 820, which may be configured generally similarly to the first member 110 and the second member 120, for example. The cable tie gun 800 is configured to cut a free end 804 of a cable tie 801. The free end 801 extends from a loop 802 formed around one or more objects.

The depicted cable tie gun 800 includes an advancement mechanism 850. The advancement mechanism 850, for example, may include conventional cable tie gun advancement mechanisms, such as used in a cable tie gun such as the Panduit model GS4H, as one example. The advancement mechanism 850 is configured to grasp the free end 804 of the cable tie 801, and tighten the cable tie 801 about at least one object (e.g., a bundle of wires or cables and/or a structure to which the wires or cables are to be secured) until a predetermined amount of tension is achieved. The predetermined amount of tension may be adjustable. Further, once the predetermined amount of tension is achieved, the advancement mechanism 850 is configured to articulate at least one of the first member 810 or the second member 820 toward the other. The advancement mechanism 850 may include a ratcheting assembly disposed inside the cable tie gun 800 that advances the free end 804 of the cable tie 801 through a guide 852 (see, e.g., FIG. 9) until the predetermined tension is reached. The advancement mechanism 850, for example, may include a grip 854 (see FIG. 9) that engages the free end 804 of the cable tie 801, with the advancement mechanism 850 actuated by a trigger 856 (see FIG. 8). Once the predetermined tension is reached, further actuation of the trigger 856 articulates the first member 810 and curved blade 812 upward toward the second member 820. The outline of the curved blade 812 is shown in phantom lines 860 in FIG. 10. The curved blade 812 may be positioned with respect to a front 870 of the cable tie gun 800 to provide a desired remaining length when the cable tie gun 800 is positioned with the front 870 at or near the receiver 815 of the cable tie 801.

Figure 11:
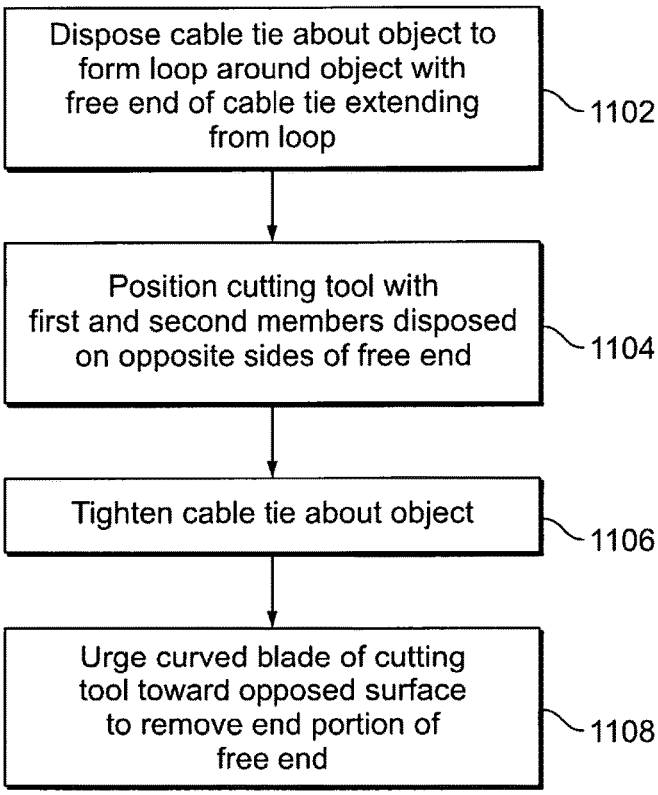
FIG. 11 is a flowchart of a method, according to an embodiment of the present disclosure.

FIG. 11 provides a flowchart of a method 1100 for cutting a free end of a cable tie, in accordance with various embodiments. The method 1100, for example, may employ or be performed by structures or aspects of various embodiments (e.g., systems and/or methods and/or process flows) discussed herein. In various embodiments, certain steps may be omitted or added, certain steps may be combined, certain steps may be performed concurrently, certain steps may be split into multiple steps, or certain steps may be performed in a different order.

At 1102 a cable tie (e.g., cable tie 101) is disposed about an object (e.g., object 103). As discussed herein, it may be noted that an "object" about which the cable tie is wrapped may include more than one component or structure. For example, the cable tie may be disposed about one or more cables and a structure to which the one or more cables are to be secured via the cable tie. The cable tie may be wrapped around the object, with a free end of the cable tie passed through a receiver to define a loop about the object. The cable tie may be initially in a loose or slack condition about the object, and subsequently tightened, as one example by hand, or as another example using a tool such as a cable tie gun.

At 1104, a cutting tool (e.g., cutting tool 100, cutting tool 600, cutting tool 800) is positioned to cut a portion off of the free end of the cable tie. In some embodiments, the cutting tool may also be used to tighten the cable tie around the object (see, e.g., 1106 discussed below). The cutting tool is positioned with a first member of the cutting tool (with the first member including a curved blade) and a second member of the cutting tool (with the second member including an opposed surface toward which the curved blade is urged to cut the free end of the cable tie) disposed on opposite sides of the free end of the cable tie. The curved blade is curved along a direction transverse to a longitudinal direction defined along the length of the free end. In some embodiments, the curved blade may be concave and is curved away from the receiver of the cable tie when the cutting tool is positioned, such that the remaining portion of the cable tie after cutting will have a convex shape (or be longer along a central portion than along the edges).

At 1106 of the illustrated embodiment, with the cutting tool positioned with the first and second members disposed on opposite sides of the free end of the cable tie, the cable tie is tightened about the object. For example, the free end of the cable tie may be grasped with an advancement mechanism, and the cable tie tightened about the object until a predetermined tension is reached. The cutting tool (e.g., an advancement mechanism of the cutting tool) may be designed and/or adjusted to provide the predetermined tension. In some embodiments, the free end of the cable tie may be disposed within and advanced through a guide of the cutting tool, with a manual input (e.g., pulling of a trigger) used to actuate a grip or other component configured to engage the cable tie (e.g., to engage ridges on an underside of the cable tie), with the grip advancing the cable tie in a ratcheting fashion through the guide until the predetermined tension is reached, at which point continued actuation of the trigger begins a cutting process. It may be noted that in other embodiments, for example using a cutting tool such as the cutting tool 600 described herein, the cable tie may be tightened by hand before positioning the cutting tool in place.

At 1108, the curved blade of the first member of the cutting tool is urged toward the opposed surface of the second member of the cutting tool. It may be noted that the urging of the first member of the cutting tool is used herein to describe a relative movement of the first member toward the second member. Accordingly, in some embodiments, the first member may remain stationary while the second member is moved toward the first member; in some embodiments, the second member may remain stationary while the first member is moved toward the second member; and in some embodiments both the first member and the second member may move toward the other. As the curved blade is urged toward the opposed surface and approaches and/or contacts the opposed surface, the curved blade cuts through the free end of the cable tie, severing an end portion and leaving a remaining portion of the free end. As discussed herein, in contrast to jagged edges left by conventional cutting approaches, the remaining portion provided by embodiments disclosed herein has smooth or non-jagged edges, and thus eliminates or reduces cutting, snagging, or scraping of the free end. The elimination or reduction of cutting, snagging, or scraping also facilitates the safe and convenient use of a remaining portion that extends a distance past the receiver of the cable tie, for example, ⅜ inch or more, easing the release of the cable tie from the receiver and removal of the cable tie.

Figure 12:
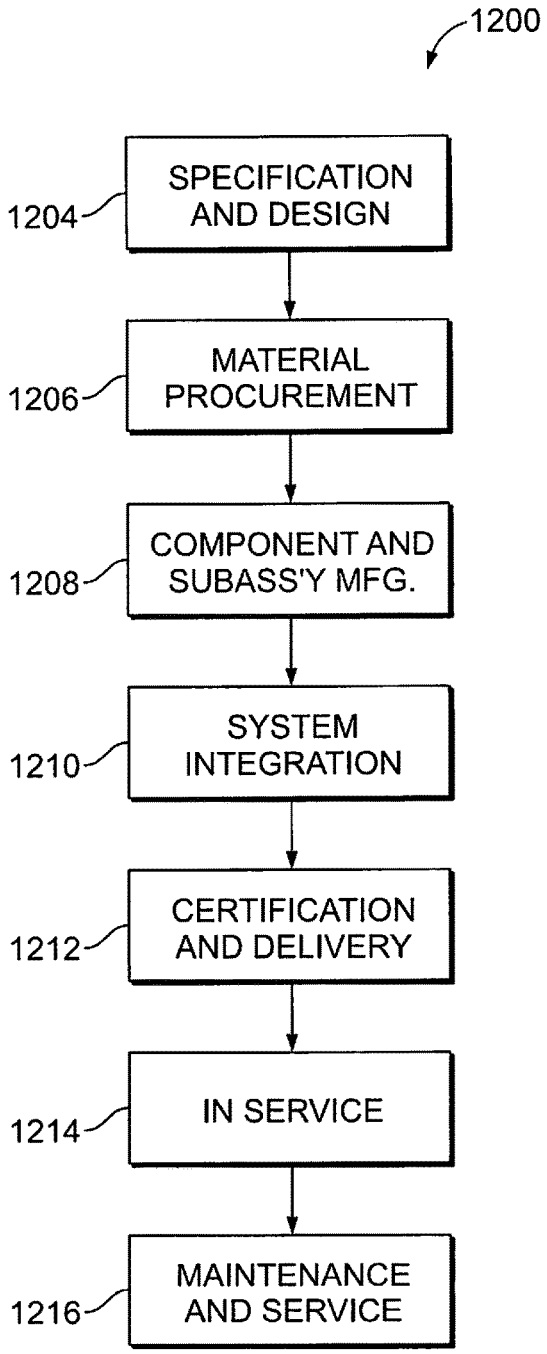
FIG. 12 is a block diagram of aircraft production and service methodology.
Figure 13:
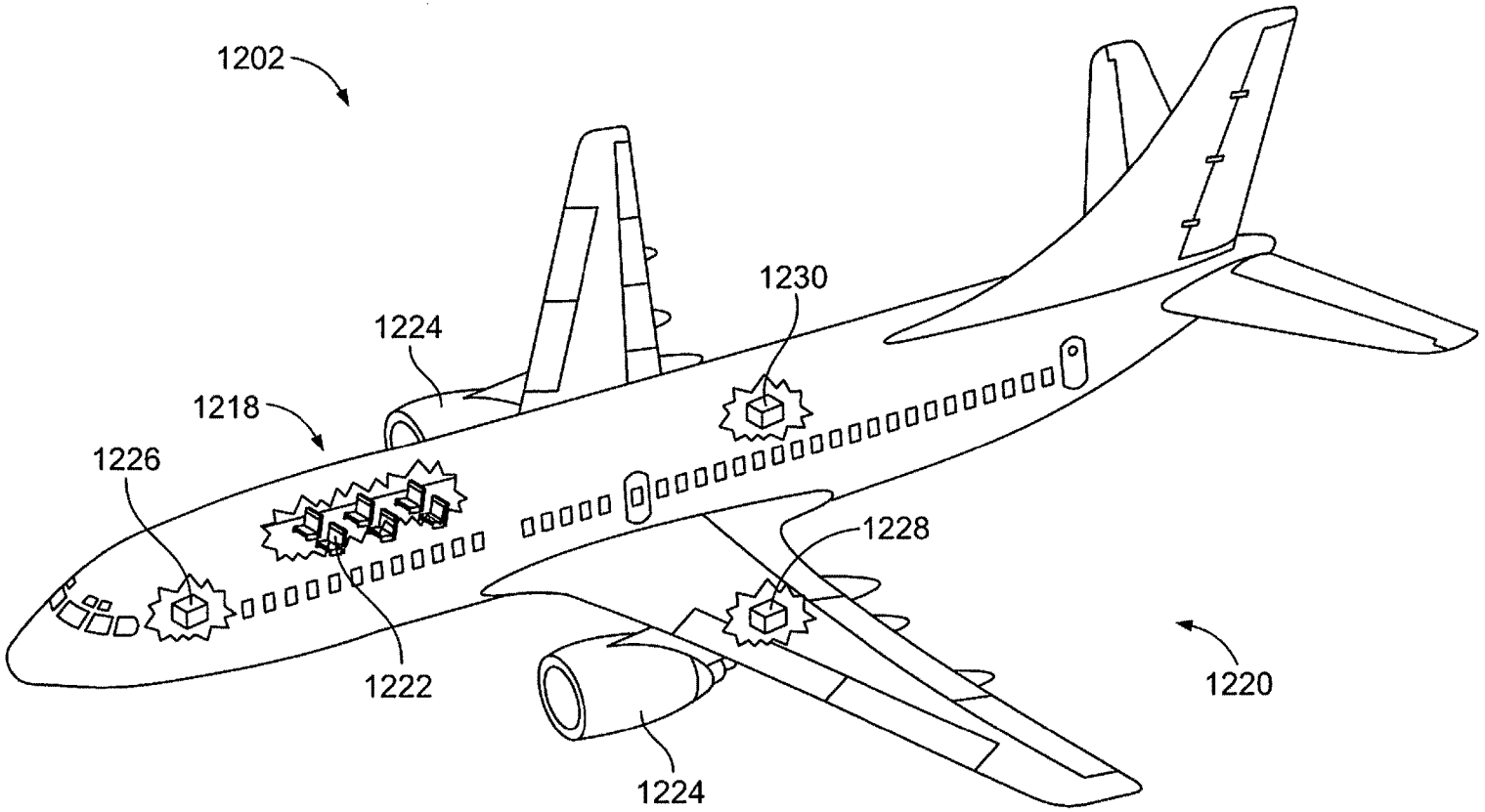
FIG. 13 is a schematic illustration of an aircraft.

Examples of the present disclosure may be described in the context of aircraft manufacturing and service method 1200 as shown in FIG. 12 and aircraft 1202 as shown in FIG. 13. During pre-production, illustrative method 1200 may include specification and design (block 1204) of aircraft 1202 and material procurement (block 1206). During production, component and subassembly manufacturing (block 1208) and system integration (block 1210) of aircraft 1202 may take place. Thereafter, aircraft 1202 may go through certification and delivery (block 1212) to be placed in service (block 1214). While in service, aircraft 1202 may be scheduled for routine maintenance and service (block 1216). Routine maintenance and service may include modification, reconfiguration, refurbishment, etc. of one or more systems of aircraft 1202. For example, in various embodiments, examples of the present disclosure may be used in conjunction with one or more of blocks 1208, 1210, or 1216.

Each of the processes of illustrative method 1200 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 13, aircraft 1202 produced by illustrative method 1200 may include airframe 1218 with a plurality of high-level systems 1220 and interior 1222. Examples of high-level systems 1220 include one or more of propulsion system 1224, electrical system 1226, hydraulic system 1228, and environmental system 1230. Any number of other systems may be included. Although an aerospace example is shown, the principles disclosed herein may be applied to other industries, such as the automotive industry. Accordingly, in addition to aircraft 1202, the principles disclosed herein may apply to other vehicles, e.g., land vehicles, marine vehicles, space vehicles, etc. In various embodiments, examples of the present disclosure may be used in conjunction with one or more of airframe 1218 or interior 1222.

Apparatus(es) and method(s) shown or described herein may be employed during any one or more of the stages of the manufacturing and service method 1200. For example, components or subassemblies corresponding to component and subassembly manufacturing 1208 may be fabricated or manufactured in a manner similar to components or subassemblies produced while aircraft 1202 is in service. Also, one or more examples of the apparatus(es), method(s), or combination thereof may be utilized during production stages 1208 and 1210, for example, by substantially expediting assembly of or reducing the cost of aircraft 1202. Similarly, one or more examples of the apparatus or method realizations, or a combination thereof, may be utilized, for example and without limitation, while aircraft 1202 is in service, e.g., maintenance and service stage (block 1216).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the spirit and scope of the present disclosure.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A method of cutting a free end of a cable tie forming a loop about at least one object, the free end extending from the loop and defining a longitudinal axis extending along a length of the free end, the method comprising:

positioning a cutting tool having first and second members with the first and second members disposed on opposite sides of the free end of the cable tie, the first member comprising a curved blade that is curved along at least a curved portion of the curved blade along a transverse direction that is perpendicular to the longitudinal axis, the curved portion extending along the transverse direction and the longitudinal axis, the second member having an opposed surface including a flat contact portion formed as a planar structure against which the curved portion of the curved blade is pressed when used to cut the cable tie, the planar structure extending along the longitudinal axis and the transverse direction; and urging the curved portion of the curved blade toward and into contact against the flat contact portion of the opposed surface to remove an end portion of the free end of the cable tie to provide a cable tie having a remaining portion of the free end that is curved along at least a portion of the remaining portion along the transverse direction.

2. The method of claim 1, wherein the cutting tool comprises an advancement mechanism, the method comprising:

grasping the free end of the cable tie with the advancement mechanism;

tightening the cable tie about the at least one object until a predetermined tension is reached;

wherein the curved blade is urged toward the opposed surface after the predetermined tension is reached.

3. The method of claim 1, further comprising disposing the cable tie around the at least one object to form the loop.

4. The method of claim 1, wherein the curved blade is positioned to provide a remaining portion length of at least ⅜ inch.

5. The method of claim 1, wherein the curved blade defines a concave profile, wherein the remaining portion defines a convex profile, wherein a length along a central portion of the remaining portion of the free end of the cable tie is longer than at an edge of the remaining portion of the free end of the cable tie.

6. A cutting tool for a cable tie, the cable tie forming a loop about at least one object and having a free end extending from the loop, the cable tie defining a longitudinal axis extending along a length of the free end, the cutting tool comprising:

a first member and a second member configured to be disposed on opposite sides of the free end of the cable tie, at least one of the first and second members articulable toward the other of the first and second members;

the first member comprising a curved blade, the curved blade being curved along at least a curved portion of the curved blade along a transverse direction that is perpendicular to the longitudinal axis, the curved portion extending along the transverse direction and the longitudinal axis;

the second member having an opposed surface comprising a flat contact portion formed as a planar structure against which the curved portion of the curved blade is pressed when used to cut the cable tie, the planar structure extending along the longitudinal axis and the transverse direction;

wherein urging the curved blade toward and into contact with the flat contact portion of the opposed surface removes an end portion of the free end of the cable tie, wherein a remaining portion of the free end of the cable tie is curved along at least a portion of the remaining portion along the transverse direction.

7. The cutting tool of claim 6, wherein the curved blade defines a concave profile, wherein the remaining portion defines a convex profile, wherein a length along a central portion of the remaining portion of the free end of the cable tie is longer than at an edge of the remaining portion of the free end of the cable tie.

8. The cutting tool of claim 6, wherein the curved blade defines a semi-circular profile.

9. The cutting tool of claim 6, wherein the curved blade comprises a middle portion interposed between edge portions, wherein the edge portions define a profile that is non-perpendicular to edges of the cable tie.

10. The cutting tool of claim 9, wherein the middle portion is oriented perpendicularly to the edges.

11. The cutting tool of claim 6, wherein the first and second members are joined by a pivot.

12. The cutting tool of claim 6, wherein the curved blade comprises plural blade segments.

13. The cutting tool of claim 12, wherein at least one of the blade segments is linear.

14. The cutting tool of claim 6, wherein the curved blade is positioned to provide a remaining portion length of at least ⅜ inch.

15. A cutting tool for a cable tie, the cable tie forming a loop about at least one object and having a free end extending from the loop, the cable tie defining a longitudinal axis extending along a length of the free end, the cutting tool comprising:

an advancement mechanism configured to grasp the free end of the cable tie and tighten the cable tie about the at least one object until a predetermined tension is achieved;

a first member and a second member configured to be disposed on opposite sides of the free end of the cable tie, at least one of the first and second members articulable toward the other of the first and second members, wherein the advancement mechanism is configured to articulate the at least one of the first and second members toward the other of the first and second members after the predetermined tension is achieved;

the first member comprising a curved blade, the curved blade being curved along at least a portion of the curved blade along a transverse direction that is perpendicular to the longitudinal axis;

the second member having an opposed surface;

wherein urging the curved blade toward and into contact with the opposed surface removes an end portion of the free end of the cable tie, wherein a remaining portion of the free end of the cable tie is curved along at least a portion of the remaining portion along the transverse direction.

16. The cutting tool of claim 15, wherein the curved blade defines a concave profile, wherein the remaining portion defines a convex profile, wherein a length along a central portion of the remaining portion of the free end of the cable tie is longer than at an edge of the remaining portion of the free end of the cable tie.

17. The cutting tool of claim 15, wherein the opposed surface defines a flat contact portion that is contacted by the curved blade.

18. The cutting tool of claim 15, wherein the curved blade comprises a middle portion interposed between edge portions, wherein the edge portions define a profile that is non-perpendicular to edges of the cable tie.

19. The cutting tool of claim 15, wherein the curved blade is positioned to provide a remaining portion length of at least ⅜ inch.

* * * * *